US006216779B1

(12) United States Patent
Reinhardt

(10) Patent No.: US 6,216,779 B1
(45) Date of Patent: Apr. 17, 2001

(54) DOWNHOLE TOOL ACTUATOR

(75) Inventor: Paul A. Reinhardt, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 08/992,737

(22) Filed: Dec. 17, 1997

(51) Int. Cl.[7] ..... E21B 23/00

(52) U.S. Cl. ..... 166/57; 166/66; 166/241.5; 166/243; 166/381

(58) Field of Search ..... 166/57, 66, 241.1, 166/241.5, 241.6, 243, 250.01, 255.2, 381

(56) References Cited

U.S. PATENT DOCUMENTS 5,199,497 * 4/1993 Ross ..... 166/381
5,215,145 * 6/1993 Ross ..... 166/217
5,273,116 * 12/1993 Ross ..... 166/302

* cited by examiner

*Primary Examiner*—George Suchfield
(74) *Attorney, Agent, or Firm*—Maden, Mossman & Sriram, P.C.

(57) ABSTRACT

An apparatus for orienting a downhole tool relative to a borehole. The invention comprises a phase change material such as a shape memory metal engaged with the tool in an initial position which is activatable to move into an operating position relative to the tool. An actuator activates the phase change material to orient the tool relative to the borehole. The member is engaged with said housing and with the phase change material for selective movement relative to said housing between an initial position and an operating position. The actuator activates said phase change material to move said member. A return spring can move the phase change material to or from the initial position. The invention can be combined with a logging tool or other downhole device to orient the tool within a borehole. In different applications, the invention can center the tool or urge the tool against one side of the borehole wall.

19 Claims, 5 Drawing Sheets

DOWNHOLE TOOL ACTUATOR

BACKGROUND OF THE INVENTION

The present invention relates to the field of tools run downhole in a borehole. More particularly, the invention relates to an improved actuator for operating the tool at a selected location within the borehole. The invention is particularly useful in narrow slimholes and in wells having multiple lateral lines.

Tools are run in boreholes to perform various functions and to identify certain data relevant to subsurface geologic formations and entrained hydrocarbons. For example, logging tools are run in borehole to determine the orientation, structure and composition of the borehole and subsurface geologic formations, and to identify the presence of hydrocarbons within the geologic formations. To prevent such tools from becoming stuck within a borehole, such tools are typically run "slick" with a lubricating fluid such as a drilling mud. However, lubricating fluid reduces log quality by interfering with the detection signals generated and received by the downhole tools.

Logging tools are typically centered within a borehole with articulated arms which extend outwardly to engage the borehole wall. The arms are stored in a collapsed position as the tool is lowered into the borehole and are moved outwardly from the housing by electric motors or hydraulic mechanisms. The downhole motor operates a gearbox, mechanical drive jackscrew, and actuation shoulder to open the engagement arms. The motor is powered through a cable extending to the wellbore surface. The jackscrew is engaged with cam pivots for moving the arms outwardly from the housing. A thrust bearing prevents axial movement of the motor relative to the housing, and high pressure dynamic seals prevent fluid intrusion into the housing. Such dynamic seals are subject to failure, and the resulting fluid intrusion can damage motors and electrical connections, and can pack off internal spaces with fluid solids.

Advanced drilling techniques and new completion procedures have increased the complexity of downhole boreholes. Multilateral and horizontal completions shorten the turning radius in deviated wellbores and in the transition between connecting borehole sections. Such boreholes require compact tools which are manueverable through tight borehole turns and intersections. To navigate narrow boreholes, new tool designs must be smaller than conventional systems. However, the systems must be smaller without reducing the data acquisition and processing capabilities of the tool. Improved downhole tools should be able to carry increased instrumentation capabilities and to carry high resolution equipment.

Materials such as shape memory alloy ("SMA") provide actuators for different applications, however SMAs are not conventionally used downhole in boreholes because of operating temperature limitations. SMAs comprise special alloys having the ability to transform from a relatively hard, austenitic phase at high temperature to a relatively flexible, martensitic phase at a lower temperature. SMAs comprise highly thermally sensitive elements which can be heated directly or indirectly to deform the SMA, and can be produced with one-way or two-way memory. An electrical current can resistively heat the SMA to a phase activation threshold temperature by the application of a small electric current through contact leads. Alloy materials providing SMA characteristics include titanium/nickel, copper/zinc/aluminum, and copper/aluminum/nickel compositions.

An SMA in a wire form has two states separated only by temperature. When cool, the SMA is in the martensitic state where the wire is relatively soft and easily deformable. When warmed above the activation temperature, the SMA wire is transformed into the austenitic state wherein the wire is stronger, stiffer and shorter than in the martensitic state. In the martensitic state, an SMA wire is deformed under a relatively low load. When heated above the activation temperature, the SMA wire remembers the original shape and tends to return to such shape. As the SMA wire is heated and contracts, internal stresses opposing the original deformation are created so that the SMA wire can perform work. SMA actuators can use SMA wire in tension as a straight wire or in torsion as a helical wire coil.

The SMA phase transition occurs at a temperature known as the activation temperature. For a titanium/nickel (TiNi) composition, activation temperatures in a range between plus one hundred degrees and minus one hundred degrees C have been demonstrated. In the lower temperature martensitic phase, the SMA is relatively soft and has a Young's modulus of 3000 Mpa. After the SMA is heated above the activation temperature, the phase transition to a relatively hard austenite phase has a Young's modulus of 6,900 Mpa. If the SMA is not overly deformed or strained, the SMA will return to the original, memorized shape. If the SMA is then cooled, the SMA mechanically deforms to the original martensitic phase. In an SMA formed as a coil spring, heating of the SMA shortens the spring, and cooling the SMA permits the SMA to return to the longer original configuration.

During the manufacture of an SMA, the SMA material is annealed at high temperature to define the structure in the parent, austenitic phase. For TiNi, the annealing temperature can be 510 degrees C. for one hour. Upon cooling, the SMA will automatically deflect away from the programmed shape to the configuration assumed by the SMA in the martensitic phase. The SMA can then be alternately heated or cooled with conductive or internal resistance heating techniques to convert the SMA between the austenitic and martensitic phase structures.

As the SMA is heated and cooled, the SMA structurally contracts up to 5% in typical cyclic applications. Contractions up to 16% have been demonstrated, however the number of useful cycles are limited. Deflection of the SMA between the austenitic and martensitic phases can be harnessed with mechanical linkages to perform work. Although 5% contraction provides a relatively small range of motion, the recovery force can provide forces in excess of 35 to 60 tons per square inch for linear contractions. The rate of mechanical deformation depends of the rate of heating and cooling. In conventional applications, the SMA can be mechanically returned by a restoring force to the configuration of the martensitic shape. This use of a restoring force impacts the geometry and size of mechanisms proposed for a particular use.

SMA materials can be formed into different shapes and configurations by physically constraining the element as the element is heated to the annealing temperature. SMA alloys are available in wire, sheet and tube forms and can be designed to function at different activation temperatures. Large SMAs require relatively high electric current to provide the necessary heating, and correspondingly large electrical conductors to provide high electric current. Efforts have been made to combine SMA elements with different mechanical devices to accomplish the desired work.

SMAs are used in medical devices, seals, eyeglasses, couplings, springs, actuators, and switches. Typically, SMA devices have a single SMA member deformable by heating and have a bias spring for returning the SMA to the original position when cooled. Other actuators termed "differential type actuators" are connected in series so that heating of one SMA deforms the other, and heating of the other SMA works against the first SMA.

U.S. Pat. No. 4,556,934 to Lemme et al. (1985) disclosed a shape memory actuator having an end fitting thickness forty percent of the original thickness. The end thickness was reduced so that less current through the end section was required to raise the end temperature above the activation temperature, and the end was cold rolled to strengthen such end against failure.

In U.S. Pat. No. 4,899,543 to Romanelli et al. (1990), a pretensioned shape memory actuator provided a clamping device for compressing an object. The actuator comprised a two-way shape memory alloy pre-tensioned to a selected position, and then partially compressed to an intermediate position. The actuator shortened when heated, and then returned to the intermediate clamping position when cooled. The shape memory actuator was formed as a clamping ring or as a coiled spring to accomplish the selected clamping motion.

U.S. Pat. No. 5,127,228 to Swenson (1992) described a shape memory actuator having two concentric tubular shape memory alloy members operated with separate heaters. The torsioned members were engaged at one end so that actuation of one element performed work on the other element, thereby providing a torque density higher than that provided by electromechanical, pneumatic or hydraulic actuators.

U.S. Pat. Nos. 4,979,672 (1990) and 5,071,064 (1991) to AbuJudom et al. disclosed two shape memory alloy elements in the form of a coil spring for operating a damper plate. An electrically conductive rotational connector connected each shape memory element to a control unit and to a stationary member. Each shape memory element was incrementally heated to move a damper plate into intermediate, open and closed positions. U.S. Pat. No. 5,176,544 to AbuJudom et al. (1993) disclosed an actuator having two shape memory elements to control the position of a damper plate. The shape memory elements were shaped as coil springs. One shape memory element moved the damper to an open position, and another shape memory element moved the damper to a closed position.

U.S. Pat. No. 5,445,077 to Dupuy et al. (1995) disclosed a SMA for providing a lock to prevent accidental discharge of a munition. Environmental heating around the munition activated the SMA to operate a munition lock.

U.S. Pat. No. 5,405,337 to Maynard (1995) disclosed a flexible film having SMA actuator elements positioned around a flexible base element. A flexible polyimide film provided the foundation for the SMA actuator elements. Switches were attached with each SMA actuator element, and a microprocessor controller selectively operated the switches and SMA actuator elements to guide the deformation of the base element. U.S. Pat. No. 5,556,370 to Maynard (1996) disclosed an actuator formed with a negative coefficient of expansion material for manipulating a joint. SMA actuators were coiled around a joint to provide three dimensional movement of the joint.

SMAs are limited due to certain operating characteristics. The operable speed of SMAs is limited by the cooling rate of the elements. After the heat source is removed by disconnecting the electrical current or by removing the heat source, the SMA cools through convection or conduction. Bias spring actuators do not inherently have two stable positions, and the work output for SMAs per unit volume significantly decreases if the SMAs are used in a bending application. Internally heated SMAs are limited to relatively small cross sections because the current requirements increase with larger cross sectional area. SMAs are limited by the range of deflection, the deflection of the SMA in a single direction, power requirements, the environmental operating temperatures, and the time required for operation of the SMA.

Conventional downhole tools are limited by the motor size necessary to operate the tools, and the borehole dimensions and configuration. Accordingly, a need exists for improved downhole tools operable within narrow boreholes. Such tools should be compact, inexpensive, reliable, and should be retractable when not in use.

SUMMARY OF THE INVENTION

The invention provides an apparatus for orienting a downhole tool relative to a borehole, and for allowing tool components to conform to the borehole dimensions. The invention comprises a phase change material engaged with the tool in an initial position which is activatable to move into an operating position relative to the tool. An actuator activates the phase change material to orient the tool relative to the borehole.

In other embodiments of the invention, a housing is engaged with the phase change material, and a member is engaged with said housing and with the phase change material for selective movement relative to said housing between an initial position and an operating position. The actuator activates said phase change material to move said member. The phase change material can comprise a shape memory alloy capable of returning to the initial position when the actuator is deactivated, and a return means can move the phase change material to or from the initial position. The invention can be combined with a logging tool or other downhole device to orient the tool within a borehole. In different applications, the invention can center the tool or can urge the tool against one side of the borehole wall.

DESCRIPTION OF THE PREFERRED EMBODIMENTS

The invention provides an apparatus for actuating downhole tools with a phase change material such as a shape memory alloy. The invention is particularly suited for downhole tools in slender boreholes such as slimholes, in highly deviated wells, and in the connections between multilateral wells.

Figure 1:
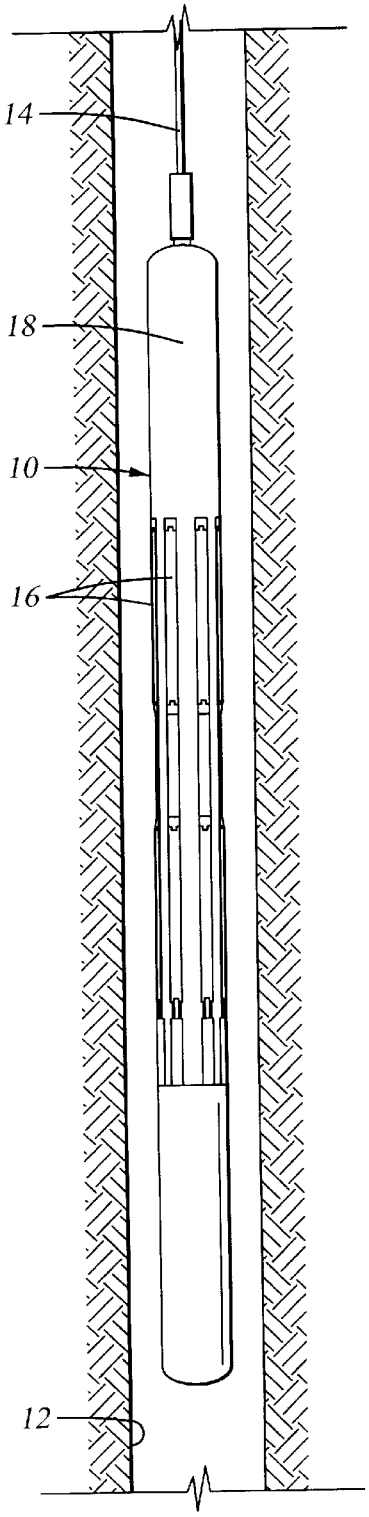
FIG. 1 illustrates a tool in an initial position for entry into a borehole.

Referring to FIG. 1, downhole tool 10 is positioned within borehole 12. Tool 10 can be lowered into borehole with a cable or tubing element identified as slickline 14. One or more extendible arms 16 are pivotably attached to tool housing 18 and are run into borehole 12 in an initial position having a minimal cross section. This configuration reduces tool sticking as tool 10 is run into borehole 12, particularly in areas where borehole 12 has a tight turning radius or where multiple boreholes are joined.

Figure 2:
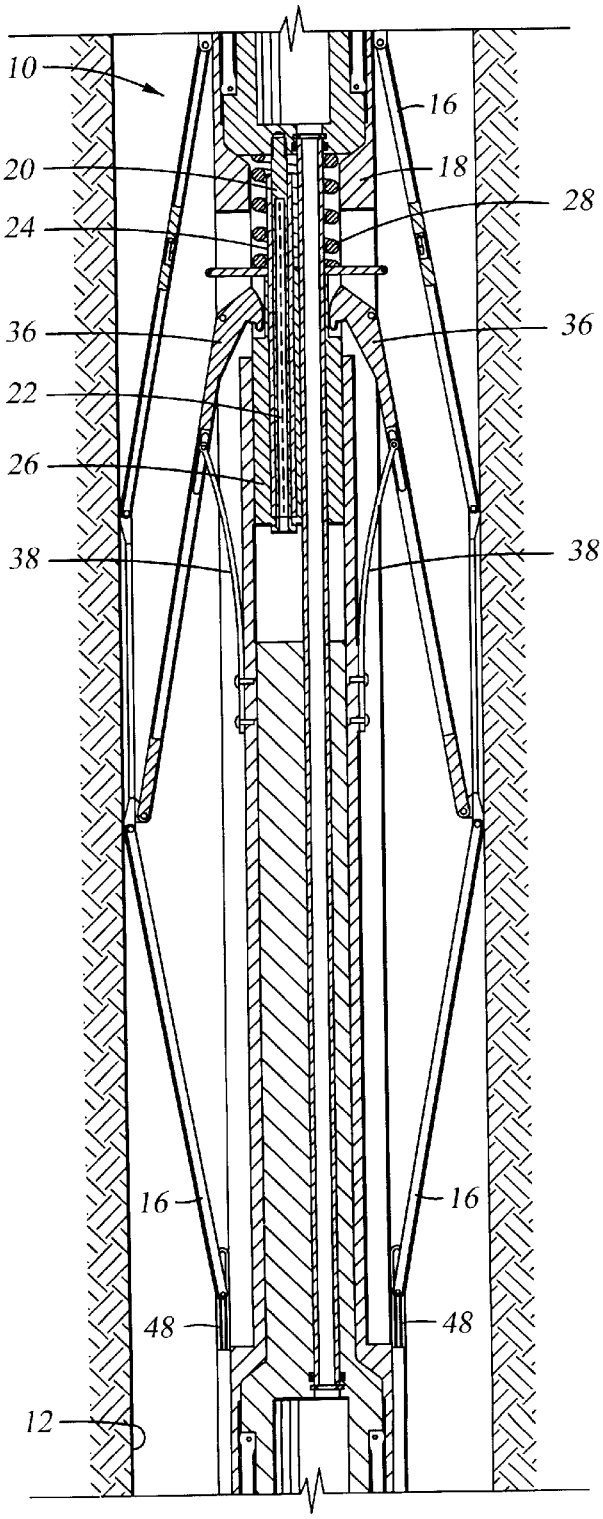
FIG. 2 illustrates the tool after an arm has been extended.

FIG. 2 illustrates the invention after tool 10 has been actuated to extend arms 16. Phase change material member such as a shape memory alloy tube ("SMA") 20 is attached to shoulder 60 within housing 18 and is selectively heated with internal heater 22. Heater 22 can comprise an electrical circuit which passes electric current through SMA 20 and heats SMA 20 with resistance heating. Alternatively, heater 22 can comprise a free standing heating element for heating SMA 20 through conduction, convection, radiation, or a combination of these techniques. Insulation jacket 24 is positioned on the outside of SMA 20 to reduce thermal losses and to more carefully control the temperature of SMA 20. SMA 20 is attached to load transfer sleeve 26 so that shrinkage of SMA 20 moves sleeve 26 axially within housing 18. Compression coil spring 28 is positioned between extension 40 and shoulder 60 so that spring 28 can return SMA 20 to the initial position as described below. The extension (40) is a single circular plate with a centrally located hole such that the inner diameter of the plate hole matches the inner diameter of the part of sleeve (26) that extends under cam (32). The outer portion of the extension plate (40) is suitably notched to fit into axial notches in the housing (18) and to slide axially when SMA (20) is heated or cooled.

Figure 3:
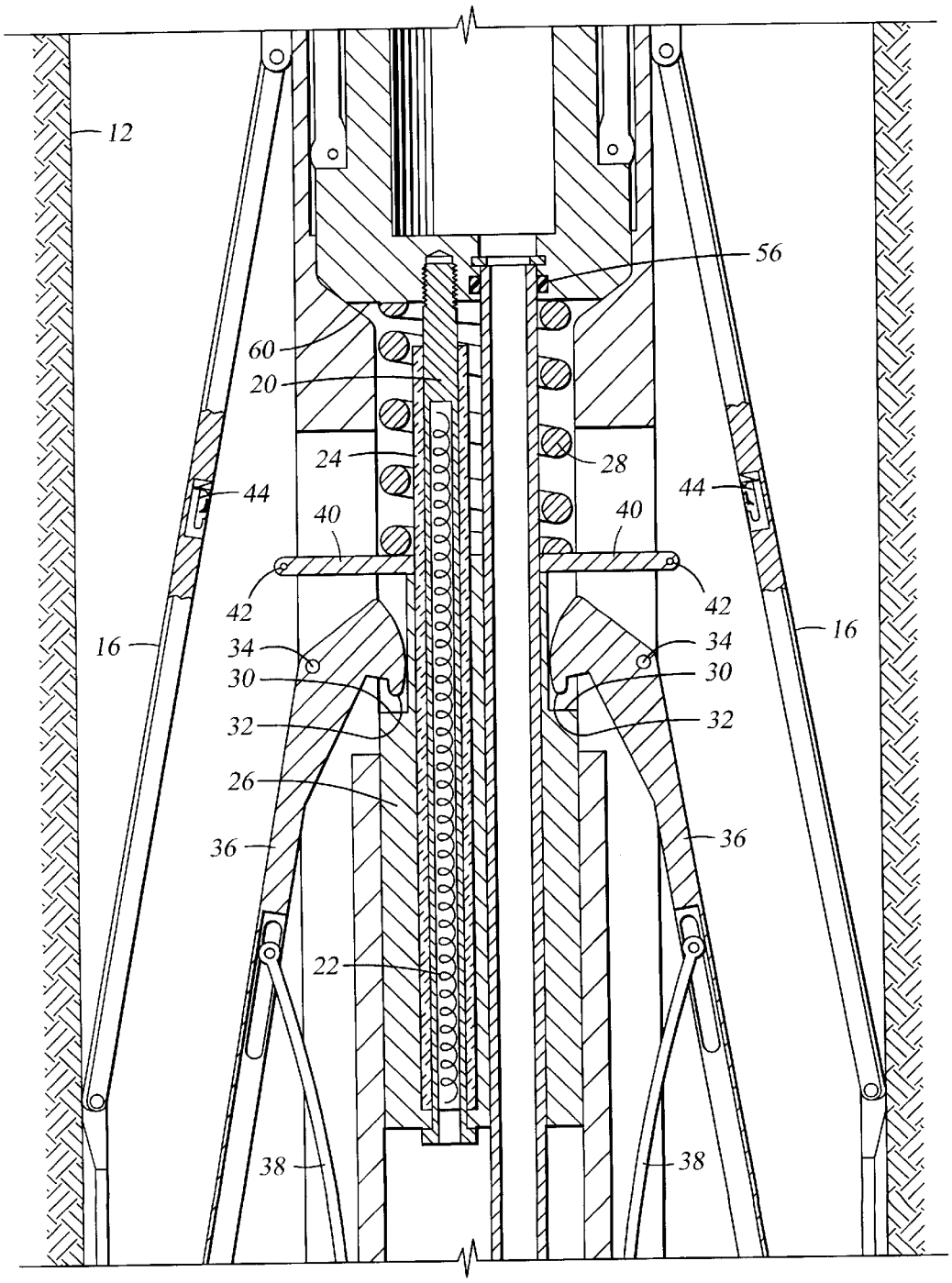
FIG. 3 shows more detail regarding the cooperation between a phase change material and the extendible arm.

Referring to FIG. 3, sleeve 26 has shoulder 30 in contact with cam 32. Cam 32 is rotatable about pivot 34 and is connected to linkage 36. Linkage 36 is pivotably attached to arm 16 and can comprise an element of arm 16. Leaf spring 38 is attached to housing 18 and to linkage 36 for urging linkage 36 radially outwardly from housing 18. Sleeve 26 further has extension 40 having locking dog 42 on an outer radial surface of extension 40. Locking dog 42 is initially retained within locking slot 44 when arm 16 is retained in an initial locked position, and is released from locking slot 44 when arm 16 is extended as shown in FIG. 3.

Figures 4, 5, 6, 7, 8:
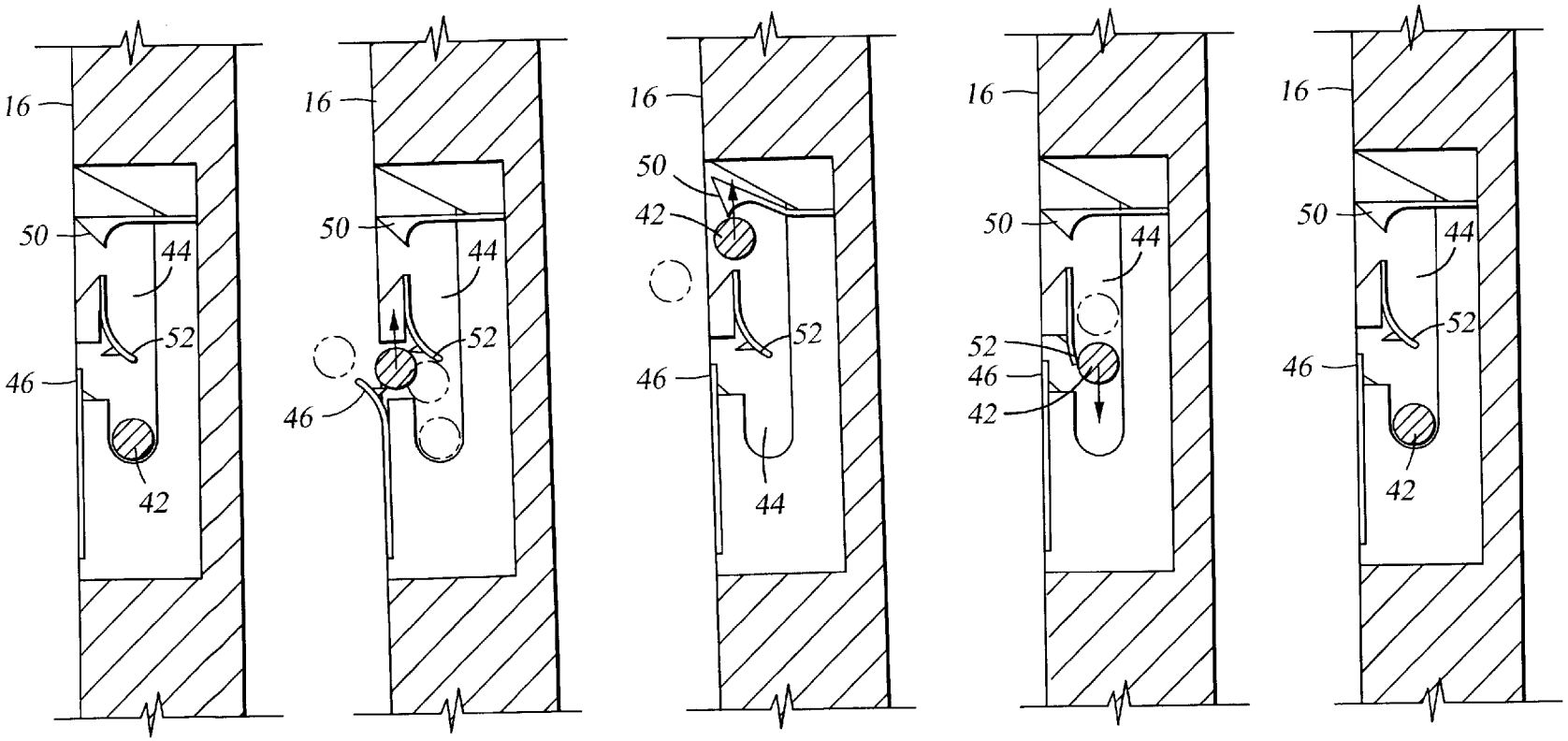
FIG. 4 illustrates the position of a locking dog and locking slot.
FIG. 5 illustrates the locking dog as it exits the locking slot.
FIG. 6 illustrates the relationship of the locking dog when the arms are in the operating position.
FIG. 7 illustrates the reentry of the locking dog into the locking slot when the phase change material is activated to the maximum change in length.
FIG. 8 shows the retention of the locking dog within the locking slot.

FIGS. 4–8 illustrate details of one inventive embodiment which selectively engages and disengages arm 16. As tool 10 is run into borehole 12, locking dog 42 is initially retained within locking slot 44 as shown in FIG. 4. When SMA 20 is activated by heating or another actuation technique SMA 20 contacts and sleeve 26 moves axially to compress coil spring 28 and to move locking dog 42 through locking slot 44 until locking dog 42 exits locking slot 44 through detent 46 as shown in FIG. 5. At this point, leaf spring 38 acts against linkage 36 to move linkage 36 and arm 16 radially outward from housing 18. Coil spring 28 is compressed during this movement and is unable to overcome the foreshortening force provided by SMA 20. Potentiometer 48 detects the deployment of arm 16 and is engaged with heater 22 to deactivate heater 22 at such point. As heater 22 is deactivated and SMA 20 cools down, SMA 20 lengthens to the initial, elongated position and sleeve 26 is pushed toward such position by coil spring 28. Operation of tool 10, such as logging or other operations, can continue as arm 16 orients tool 10. As shown in FIG. 6, locking dog 42 cannot reenter locking slot 44 during such operating position because detent 46 blocks such reentry.

At the selected time when tool 10 has surveyed the desired length of borehole 12, arm 16 is collapsed from the operating position to the initial position. This collapse can be accomplished in different ways. For the embodiment of the invention illustrated, arm 16 is collapsed by operating heater 22 to activate SMA 20. SMA 20 is activated to the full transition amount, which shortens SMA 20 and translates sleeve 26 to collapse arms 16 toward housing 18. Locking dog 42 snaps through detent 50 to enter locking slot 44 as shown in FIG. 7, and potentiometer 48 detects such position and generates a signal to deactivate heater 22. SMA 20 again cools and elongates, is returned with coil spring 28, and unloads shoulder 30 from contact with cam 32. Locking dog 42 moves past detent 52 and is returned to the initial position within locking slot 44 as shown in FIG. 8.

Figure 9:
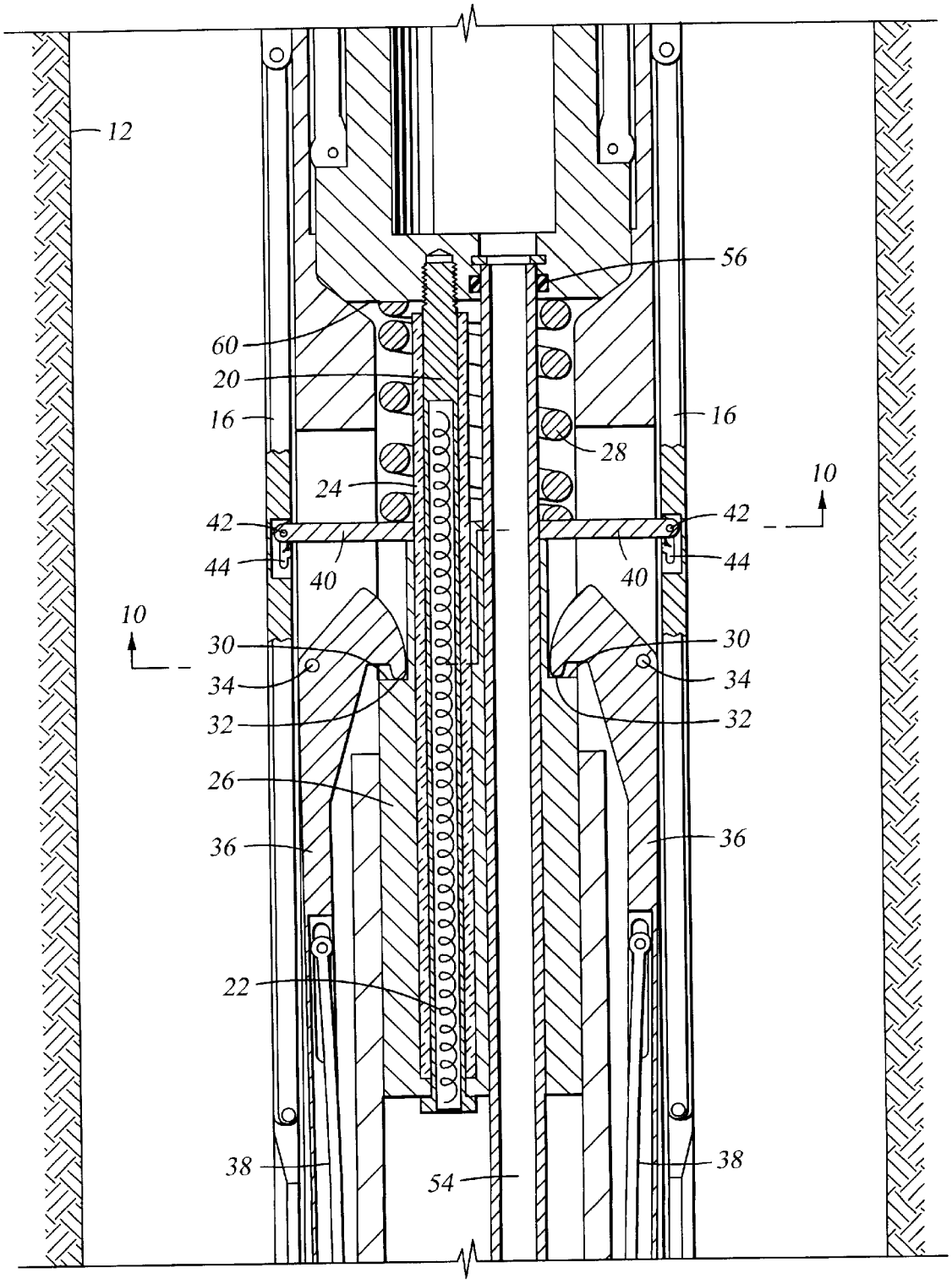
FIG. 9 illustrates the operation of the phase change material shoulder to operate the cam associated with an extendible arm.

The extension of linkage 36 and arm 16 can be controlled by the movement of shoulder 30 against cam 32. FIG. 9 illustrates the full transition heating of SMA 20 wherein shoulder 30 engages cam 32 to close arm 16 and to force locking dog 42 into locking slot 44. Alternatively, SMA 20 and sleeve 26 can continue to be moved axially until shoulder 30 releases contact with cam 32, thereby allowing arm 16 and linkage 36 to engage the wall of borehole 12 and to float between such contact and the spring force furnished by leaf spring 38.

Figure 10:
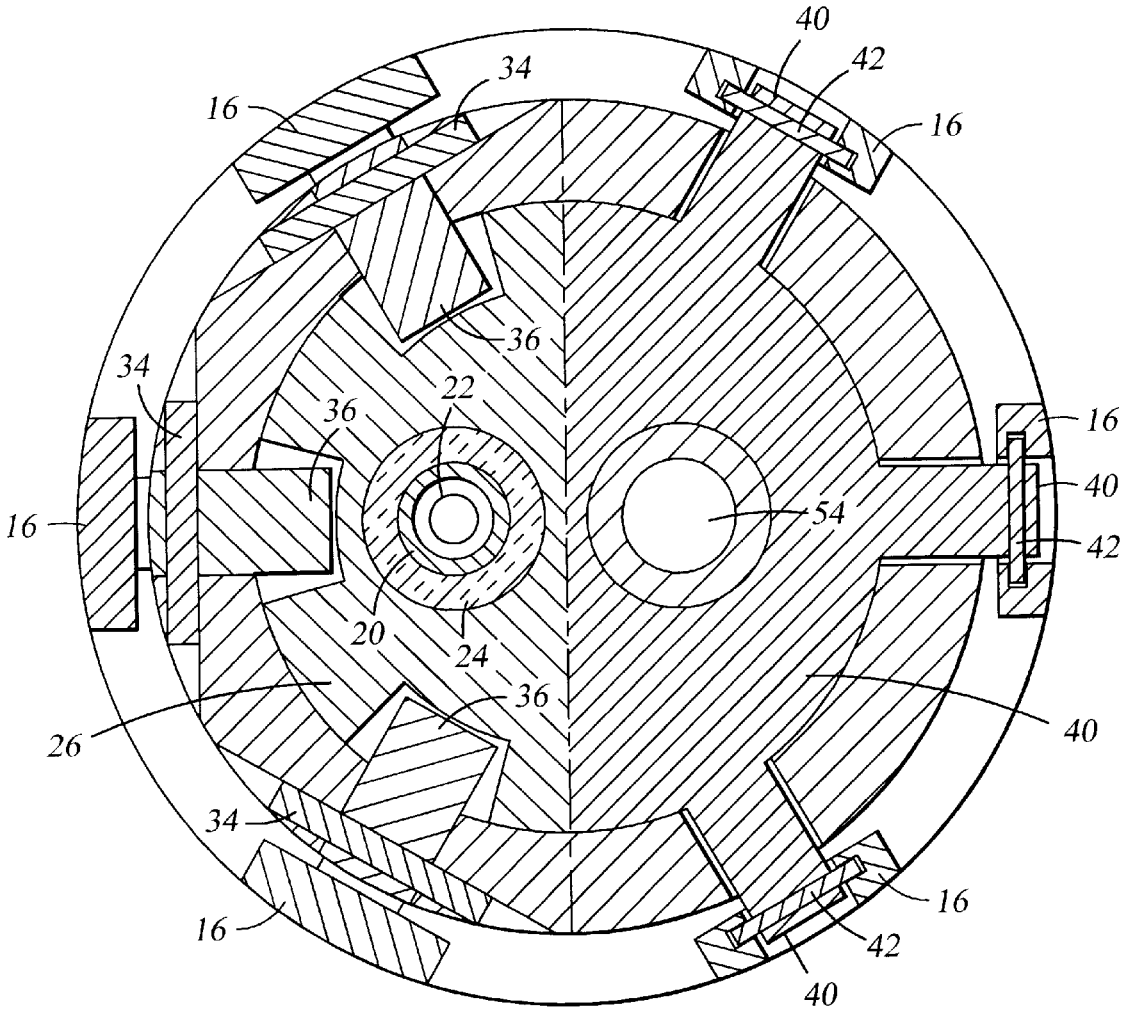
FIG. 10 illustrates a cross sectional view of the phase change material and through tubing bus.

Through-bus tube 54 extends through an interior space within sleeve 26 as shown in FIGS. 9 and 10 to permit the insertion of wire (not shown) through tool 10. Tube 54 permits other tools to be run above and below tool 10 to provide for a unique combination of different tools. Tube 54 can be fixed relative to tool 10 to eliminate the need for dynamic seals, and static seals 56 at both ends of tube 54 prevent the intrusion of fluids. Notably, all of the working elements of tool 10 can be sealed with static seals instead of the dynamic seals found in conventional tools. The elimination of dynamic seals significantly improves tool reliability by avoiding failures associated with dynamic seals. Tube 54 can be stationary to sleeve 26 as sleeve 26 moves axially relative to tool housing 18.

As used herein, the term "phase change material" means any material or structure capable of initiating movement in a member. Such materials include and are not limited by SMAs, piezoelectrics, magnetostrictive, and Terfenol-D (a registered mark of Extrema Company) materials. Phase change materials such as SMAs are activated with different techniques which can include heat, chemical processes, or mechanical movements. Phase change materials other than SMAs may accomplish less deflection and handle lower loads than SMAs, however the capabilities and characteristics of such materials are being extended. As used herein, the terms "activate" and "activatable" encompass different features which can include motion or a reaction such as heat, chemical processes, or mechanical movements. The term "orient" as used herein means to locate or place in a particular location or relationship, or to become adjusted or aligned.

The invention uses a phase change material such as an SMA to orient a housing relative to borehole 12. Although a preferred embodiment of the invention uses an SMA as the phase change material, other compositions and materials can be used to accomplish the functional result of actuating a downhole tool. The invention can orient or position downhole tool 10 within borehole 12, or can move one component of tool 10 relative to another component of tool 10. Alternatively, the invention can also accomplish the function of conforming tool 10 to borehole 12. Other features of the invention can increase the capacity and operating rate of the phase change material. For example, magnetic switches can be incorporated with an SMA to decrease the cycle time of the SMA, and the phase change material can be operated in a waveform type of operation to iteratively cycle the deformation and work performing characteristics of the phase change material.

A change of state in SMAs also changes the geometry and stress/strain relationships of the material or alloy. Such changes can cause relative motion of tool components and can actuate the tool to perform a selected task. The SMA are made of the same alloy so that they have essentially the same hysteresis and phase characteristics. The properties of the shape memory alloy will relate to the activation temperature, to the hysteresis between phases, and to the initial and final temperatures.

Because the phase transition temperature of a SMA is constant, the resistance of each SMA is directly related to the displacement. For an SMA tube having a unit length of ten, a 4% shortening would leave a final length of 9.6 units. One SMA having a 4000 pounds of force capability incorporates a central cartridge heater inside a frame having six aluminum spokes. A total of 170 wire are wound on each of the spokes, and such SMA is capable of shortening at least 140 thousandths of an inch from a total SMA length of 3.5 inches.

Operation of tool can proceed through the selected section of borehole 12. In one embodiment of the invention, a plurality of arms 16 freely float against borehole 12. If tool is pushed against one side of borehole 12, arms 16 will not snap into locking slots 44 because locking dogs 42 have been moved to a position where arms 16 rest against locking slots 44 but are unable to snap into locking slots 44. Arms 16 can center tool within borehole 12, or one or more arms 16 can urge tool 10 against one side of borehole 12. Alternatively, one or more arms 16 can orient tool in any selected direction relative to borehole 12.

Tool 10 is not "parasitic" because overtravel is not required for operation of the moving components. In typical linear locking devices, such as in a ballpoint pen, overtravel of the device is necessary to establish the locked position. The operation of the phase change material in the invention can reach the operating position without overextending or moving past the operating position. The absence of overtravel in the present invention reduces the overall length required for the operable mechanisms.

The invention replaces motorized devices, thereby reducing the actuation lengths and weights by over fifty percent. This capability provided by the invention permits operation of the invention in slimholes and highly deviated wells previously inaccessible to conventional tools. By reducing the length requirements for each tool, more tools can be run within a single tool string. The ability to reliably extend and retract standoffs permits the tools to be run within the borehole in a closed position, and opened only within the region of investigation.

The invention requires fewer components and significantly simplifies the manufacture and operation of downhole tools. The elimination of downhole electric motors provides a unique capability to the actuation of tools downhole. Such conventional systems contaminate signals in the wireline and instrument bus associated with the equipment. By eliminating downhole motors, brushes, rotors and other moving parts which generate acoustic and electric noise, the invention provides a "quieter" actuating mechanism. Because downhole instrument packages such as telemetry systems are highly sensitive to undesirable noise, interruptions to data gathering operations are reduced, certain noise filter systems can be eliminated, and the overall quality of data is enhanced. Dynamic seals are eliminated, thereby eliminating a significant maintenance requirement. These unique features of the invention significantly enhance the quality of data gathering operations The invention permits the actuating means to return to the original, unpowered position and facilitates subsequent operation of the tool through the work cycle.

In addition to the logging tool described herein, the invention is applicable to retractable standoffs in acoustic and other tools, and can center a tool or provide a lesser radial displacement away from the borehole wall. The invention reduces the possibility of binding within a borehole, therefore reducing the need to run the tool slick. This feature of the invention significantly improves the quality of borehole data by eliminating the need for lubricating fluid as the tool is run in the borehole. Additionally, the invention reduces the need for expensive dynamic seals susceptible to failure, and facilitates the placement of through-bus communication wires through the device.

Although the invention has been described in terms of certain preferred embodiments, it will be apparent to those of ordinary skill in the art that modifications and improvements can be made to the inventive concepts herein without departing from the scope of the invention. The embodiments shown herein are merely illustrative of the inventive concepts and should not be interpreted as limiting the scope of the invention.

What is claimed is:

1. An apparatus for orienting a downhole tool relative to a borehole, comprising:

a phase change material engaged with the tool in an initial position, wherein said phase change material is activatable to move into an operating position relative to the tool for orienting the tool relative to the borehole; and an actuator for activating said phase change material, wherein said phase change material is further activatable to permit movement of said phase change material from said operating position to said initial position.

2. An apparatus as recited in claim 1, further comprising a member engaged with said phase change material for extending the movement of said phase change material.

3. An apparatus as recited in claim 1, further comprising a through tool bus extending through the tool.

4. An apparatus as recited in claim 1, wherein said phase change material comprises a shape memory alloy.

5. An apparatus as recited in claim 1, wherein said phase change material is capable of moving from said operating position to said initial position when said actuator is deactivated.

6. An apparatus as recited in claim 1, further comprising a return means engaged with said phase change material for returning said phase change material from said operating position to said initial position.

7. An apparatus as recited in claim 6, wherein said return means is capable of moving said phase change material from said initial position to said operable position, and wherein said actuator is capable of activating said phase change material to move said phase change material from said operable position to said initial position.

8. An apparatus as recited in claim 1, wherein said phase change material is capable of moving into said operating position without moving past the operating position.

9. An apparatus for movement within a borehole, comprising:

a housing moveable within the borehole;

a member engaged with said housing for selective movement relative to said housing between an initial position and an operating position;

a phase change material engaged with said member, wherein said phase change material is activatable to move said member between said initial position and said operating position; and an actuator for activating said phase change material to move said member.

10. An apparatus as recited in claim 9, wherein said phase change material comprises a shape memory alloy.

11. An apparatus as recited in claim 10, wherein said actuator comprises a means for heating said shape memory alloy.

12. An apparatus as recited in claim 9, wherein said phase change material is capable of returning said member from said operating position to said initial position when said actuator is deactivated.

13. An apparatus as recited in claim 9, further comprising a return means for moving said member from said operating position to said initial position.

14. An apparatus as recited in claim 9, wherein said member contacts the borehole, when said member is positioned in said operating position, to center said housing within the borehole.

15. An apparatus as recited in claim 9, wherein said member contacts the borehole, when said member is positioned in said operating position, to urge said housing against one side of the borehole.

16. A logging tool for movement within a borehole, comprising:

a housing moveable within the borehole;

a positioning member engaged with said housing for movement relative to said housing, wherein said positioning member is selectively retained in an initial position when said housing is moved within the borehole, and wherein said positioning member is selectively moveable into an operating position when said housing is located at a selected location within the borehole;

a shape memory alloy engaged with said positioning member, wherein said shape memory alloy is activatable to move said positioning member between said initial position and said operating position;

an actuator activatable for heating said shape memory alloy to move said member; and logging equipment attached to said housing.

17. A logging tool as recited in claim 16, wherein said shape memory alloy is capable of moving said positioning member from said operating position to said initial position when said actuator is deactivated.

18. A logging tool as recited in claim 16, further comprising a return means for moving said positioning member from said operating position to said initial position.

19. A logging tool as recited in claim 16, wherein said housing is axially moveable within the borehole, and wherein said positioning member is adjustable during axial movement of said housing to accommodate variations in the borehole.

* * * * *